United States Patent [19]

Sopko

[11] 3,953,769

[45] Apr. 27, 1976

[54] ELECTRONIC SECURITY CONTROL SYSTEM

[75] Inventor: Riley M. Sopko, Glendale, Calif.

[73] Assignee: Sargent & Greenleaf, Inc., Rochester, N.Y.

[22] Filed: July 29, 1974

[21] Appl. No.: 492,422

[52] U.S. Cl. ..... 317/134; 317/151; 340/164 R

[51] Int. Cl.[2] ..... E05B 49/00

[58] Field of Search ..... 317/134, 151, DIG. 4, 317/DIG. 6; 340/164 R, 168 B, 147 MD, 149 R, 149 A, 274 R, 274 C; 70/277, 278; 58/152

[56] References Cited

UNITED STATES PATENTS

| | | | |
|---|---|---|---|
| 1,283,845 | 11/1918 | Marchant | 317/134 |
| 3,126,490 | 3/1964 | Stern | 317/DIG. 4 |
| 3,140,428 | 7/1964 | Shepard | 317/DIG. 4 |
| 3,587,051 | 6/1971 | Hovey | 317/134 R |
| 3,641,396 | 2/1972 | Kossen et al. | 317/134 |
| 3,772,574 | 11/1973 | Hughes | 317/134 |
| 3,813,533 | 5/1974 | Cone et al. | 58/152 |
| 3,825,898 | 7/1974 | Miller | 340/164 R |

*Primary Examiner*—J. D. Miller
*Assistant Examiner*—Harry Moose
*Attorney, Agent, or Firm*—Poms, Smith, Lande & Glenny

[57] ABSTRACT

Actuation of an electrically operated lock is controlled by an electronic permutation circuit including an array of code entry push-button switches disposed for operation at the entrance to a secured area and a plurality of code selector switches mounted inside the secured area for setting a predetermined code sequence. If the correct code sequence is entered, corresponding to the setting of the code selector switches, an electronic counter is sequentially advanced to a selected terminal state determined by a code length selector switch which is connected to and for operating the electrically controlled lock. The time interval during which the lock is electrically actuated may be selected by a latch time selector switch mounted along with the code selector switches inside the secured area. The occurence of a preselected number of errors during code entry, a number which may be set by a selector switch mounted along with the other selector switches, provides for activating a penalty period during which the entire system is disabled and inoperable. The duration of the penalty time may also be varied by another selector switch. A common counting circuit is employed for the error count, penalty time and latch time modes of the system. For driving a solenoid-type lock or latch, output circuitry is provided in one embodiment to include a transistorized latch driver circuit for developing a surge current for instantaneous, positive opening of the solenoid lock or latch. In another embodiment, a digital clock and display having a 24 hour timing format is provided in combination with an elapsed day counter circuit to permit use of the system as a time lock. Opening of the lock is inhibited until the expiration of a preselected time interval which may be set to a desired number of elapsed days, hours and minutes.

22 Claims, 6 Drawing Figures

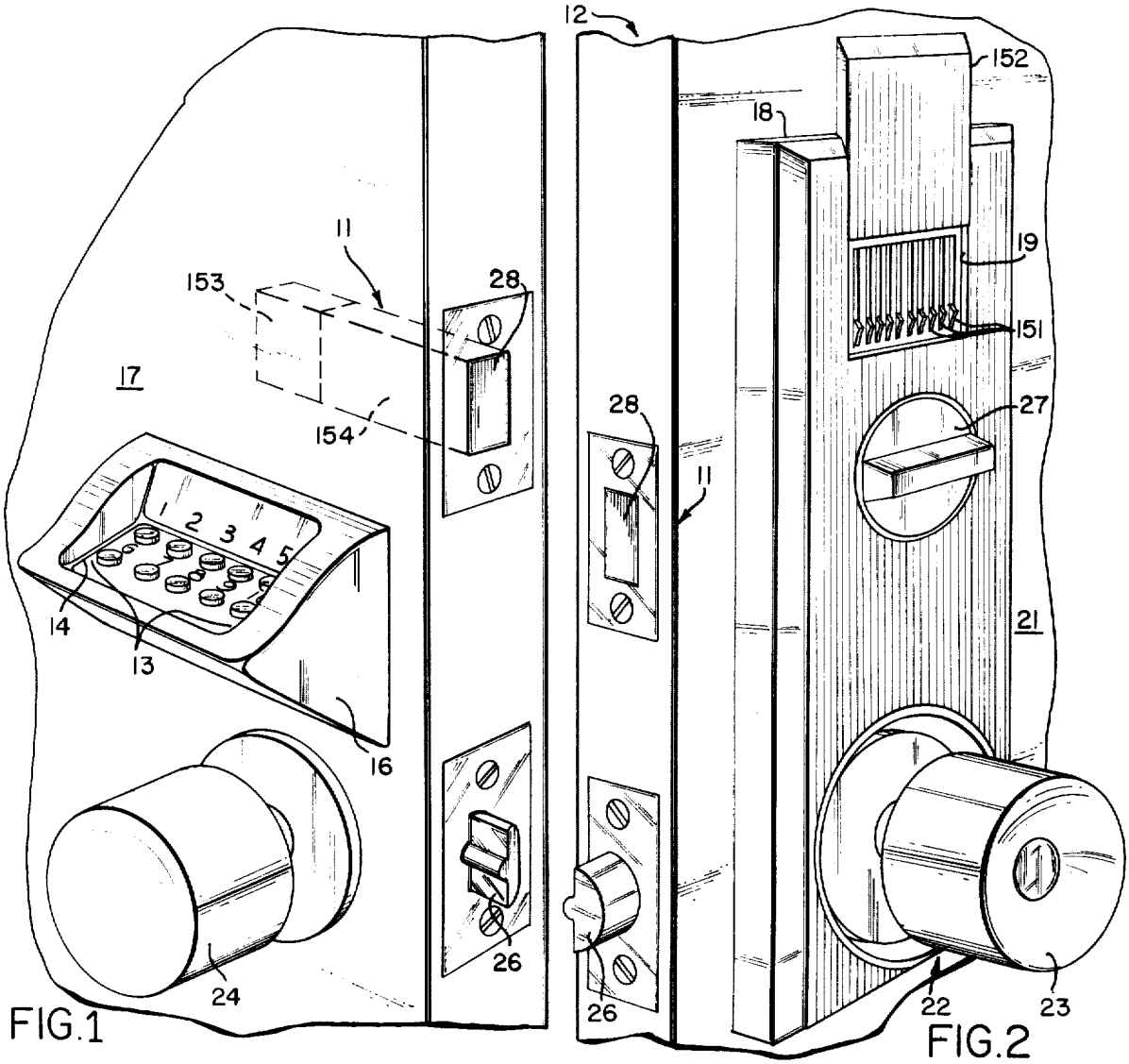
FIG.1
FIG.2
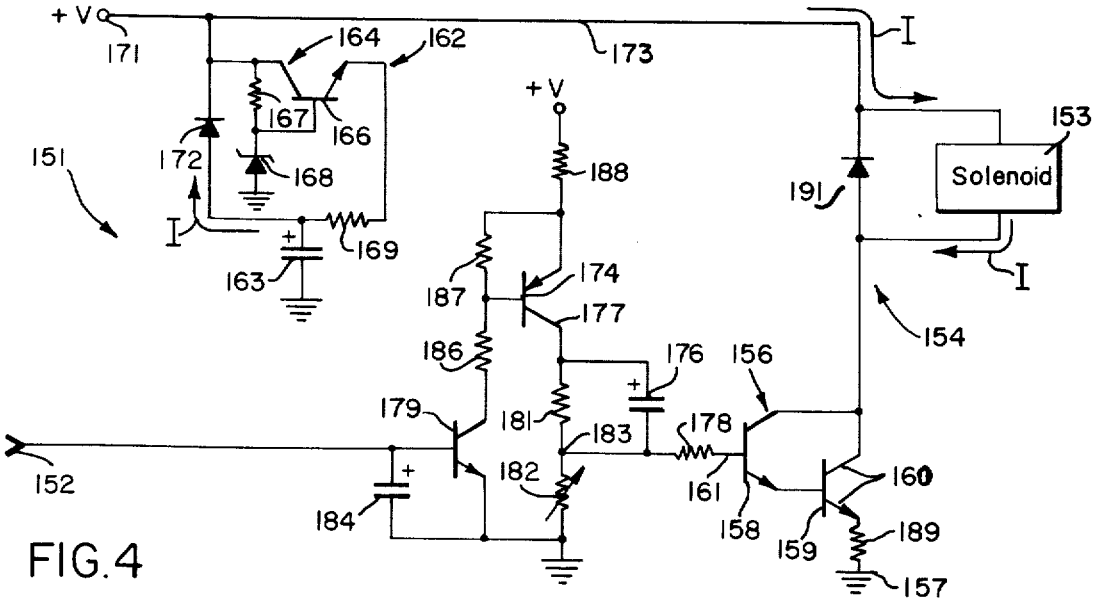
FIG.4

FIG.5
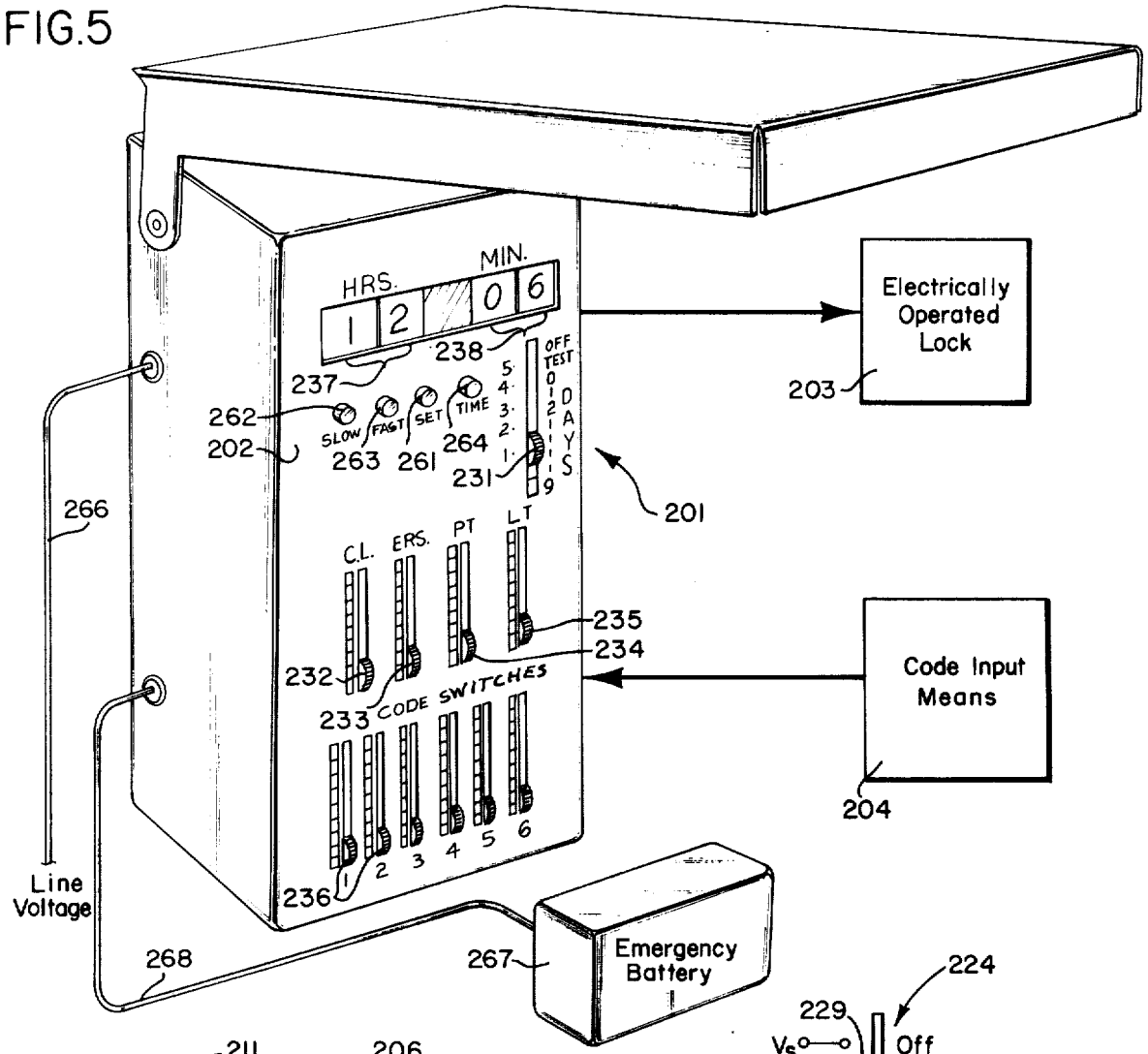
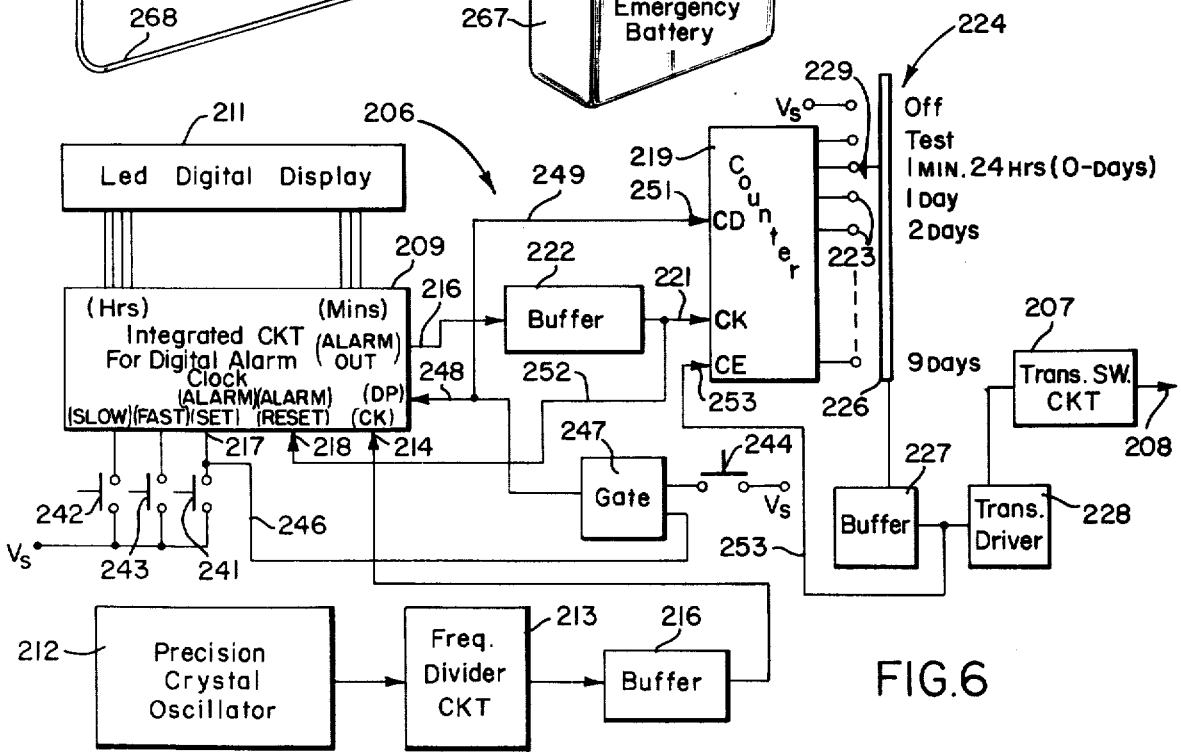
FIG.6

ELECTRONIC SECURITY CONTROL SYSTEM

BACKGROUND OF THE INVENTION

In general, the present invention relates to security control systems and more particularly to an electronic permutation lock which opens in response to a predetermined combination code, where the code may be entered for example by manually operated electromechanical switches.

Electronic permutation or combination locks are in general known and the utility thereof is widely accepted. Many of the electronic combination locks heretofore proposed have merely substituted the electronic functions for the mechanical tumbler parts of the well-known conventional combination lock. Thus such previous electronic systems merely provide an electronic counterpart to the mechanical combination lock and in general provide substantially the same security functions which have long been within the capability of the mechanical lock.

It is a general object of the present invention to provide an electronic permutation or combination security control system having far greater versatility and flexibility than is capable of mechanical devices. For example, it may be desirable in certain security installations to change the length or complexity of the entry code necessary for operating the lock. During periods of frequent use of the code entry such as during the daytime, it may be desirable to provide a short two, three or four digit entry code, whereas other periods such as at nighttime will demand a higher security entry code of five or more digits.

Also, it is many times desirable to permit changing of the entry code. For example, some security systems may require the code to be changed periodically to minimize the risk of the code being leaked to an unauthorized person. In other situations, two or more different codes may be provided for use during different times of the day. One code for use during daytime hours might be known to all authorized personnel, whereas a nighttime code may be known only to the attendants or night watchmen.

Some previously proposed electronic combination locks have recognized and used certain security features particularly within the capabilities of the electronic art. For example, many systems provide for the detection of errors occurring during entry of a combination code and provide for some form of disablement of the lock circuitry in response thereto. However, it would be desirable to provide in accordance with the aforementioned general objective of the present invention to provide for not only detecting errors, but to permit a selectable number of errors to occur prior to disablement of the lock. This would permit the control system to be set according to the desired security level. For a high security situation, the number of errors permitted prior to disablement would be set to zero, 1 or 2 for example. On the other hand, a low level of security may permit the occurrence of a plurlity of errors before opening of the lock is foreclosed, thus permitting ease of access by low security personnel or during low security periods. Additionally, the error number setting would be useful in introducing the system to security employees, with a high error setting being used initially until they have become familiar with the system and/or a code number, and thereafter reducing the error setting to a low level for higher security.

The duration of the lock disablement following a threshold error count is desirably adjustable to accommodate the particular security requirements. For a low security system, the disablement interval or penalty time may be relatively short to provide a compromise between preventing unauthorized entry and yet affording eventual access to authorized personnel who is merely careless in entering the proper code. On the other hand, a high security system may demand a much longer penalty time to preclude the breaking of the combination code by an authorized person having sufficient time to try each of the possible permutations. Thus a penalty time setting would be a desirable feature to have in a sophisticated, versatile security system.

Typically, the output of the electronic combination lock is employed to drive some form of electromagnetic release or solenoid lock. The time interval during which the lock is driven to the open condition can be a critical characteristic of the system. For example, a solenoid lock which is driven to the open condition and maintained there for an extended length of time is undesirable because unauthorized personnel may sneak through the security access following entry of an authorized person. To minimize this possibility, it would be desirable to provide a variable, setable time interval during which the solenoid lock is maintained open. Thus, depending upon the situation, the lock open time may be set for one or two seconds on up to several seconds depending upon the expected time required for the authorized personnel to enter the code and open the door, safe, or other secured area. This entry time may vary depending upon the installation, and thus the flexibility provided by the variable, setable lock open time would be advantageous.

Although the code combination provides a great deal of security against unauthorized entry, it is nevertheless desirable in some systems to provide in addition thereto a time lock feature. In such case, the security lock is disabled for a predetermined, set time, and only after expiration of this time will the circuit respond to the entry of the proper code to open the lock. Time locks are desirable in many installations including bank vaults, computer rooms, and in general in any security area which is to be locked up during certain time frames such as overnight. Although time locks are in general known, they have not heretofore been provided in the most advantageous and compatible form for use with an electronic permutation lock.

Similarly, it is well-known to provide some form of controlled, electrical power supply for operating the solenoid or other electromagnetic locks responsive to the electronic combination circuitry. However again, these known circuits have not been provided in a form which is most advantageous for use in combination with a sophisticated electronic control circuit. For example, even though the electronic control circuitry itself is operable with very low power requirements, even permitting the use of small emergency batteries, previously proposed solenoid driver circuits have required a great deal of power and are many times incapable of being operated by a small battery. This, of course, restricts the otherwise available flexibility of the electronic control. Accordingly, it would be desirable to provide a solenoid or latch driver circuit which is more compatible to a sophisticated electronic permutation lock, and more particularly to provide such a driver circuit having a relatively low electrical power requirement.

In accordance with the present invention the foregoing features are not only recognized as desirable characteristics of a sophisticatd, versatile security control system, moreover all of these features are constructed in a manner which is inherently reliable and is capable of being mass manufactured at a relatively low per unit cost. For example, in order to reduce the overall cost of the system, certain common circuit components are used for a plurality of different functions thereby reducing the number of required components and simplifying the production assembly.

These and other objects, advantages and features of the electronic permutation lock and control system in accordance with the present invention will become apparent to those skilled in the art from a consideration of the following detailed description of a few particular embodiments thereof. Reference will be made to the appended sheets of drawings in which:

BRIEF DESCRIPTION OF THE DRAWINGS

FIGS. 1 and 2 are perspective views of opposite sides of a security door for the security area equipped with the electronic permutation lock and control system of the present invention. FIG. 1 shows the code entry push-button panel mounted on the nonsecured side of the door, while FIG. 2 illustrates the control panel including the selector switches mounted on the secured side of the door and here forming a part of the doorknob assembly.

FIG. 4 is a schematic diagram of a solenoid driver circuit also utilized in the system of FIGS. 1 and 2 for operating a solenoid release or lock mounted in this instance within the door itself.

FIG. 5 is a perspective view of a control panel for an alternative embodiment of the present invention in which a time lock feature is included in the system.

FIG. 6 is a comprehensive circuit and block diagram of the time lock feature of the embodiment of the invention shown in FIG. 5.

DESCRIPTION OF EXEMPLARY EMBODIMENTS

Figure 3:
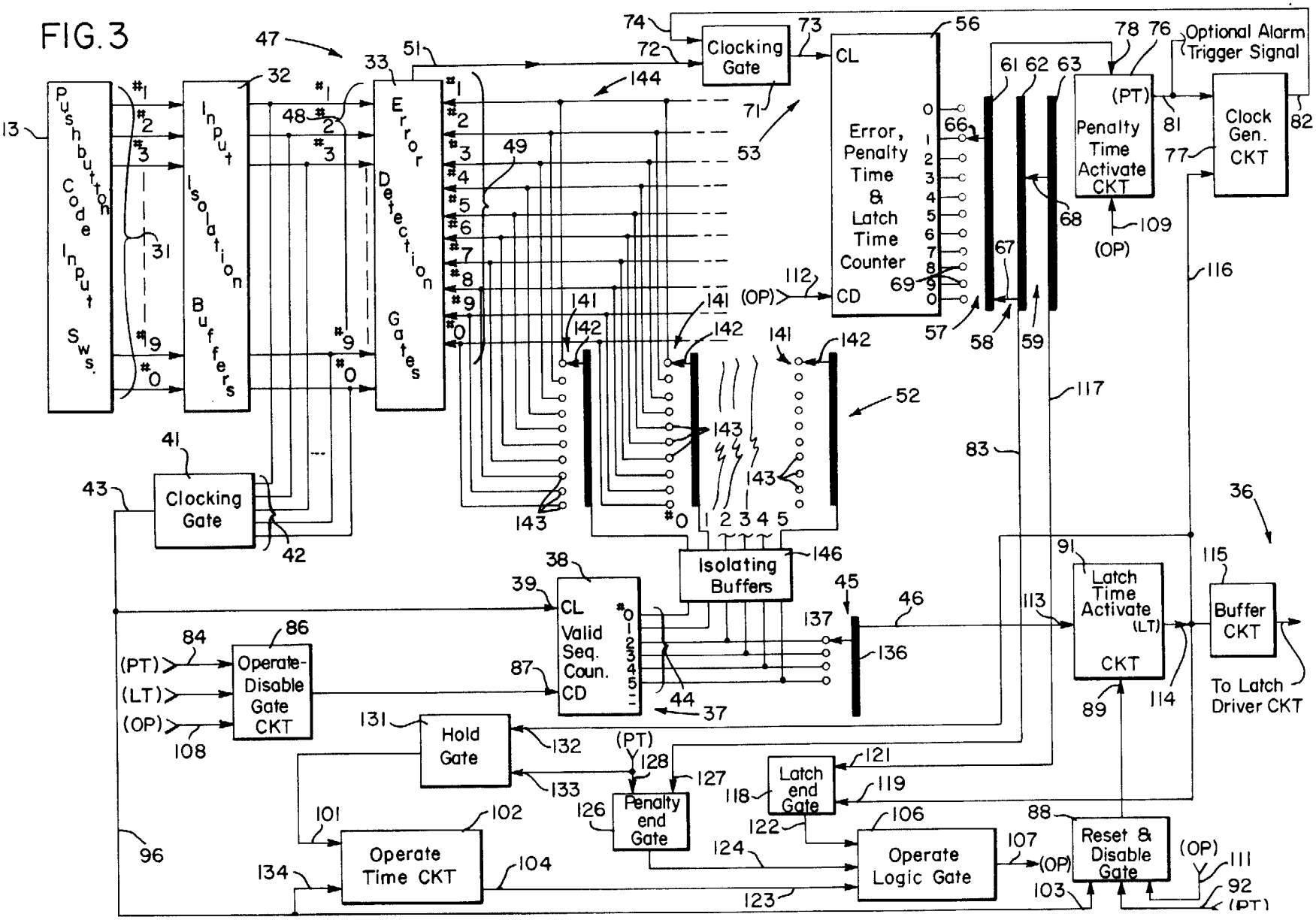
FIG. 3 is an overall circuit and block diagram of the electronic permutation lock and control circuitry utilized in the system of FIGS. 1 and 2.

With reference to FIGS. 1 through 3, the electronic permutation lock and control system of the present invention may be used for a security installation in which an electrically operated lock assembly 11 is selectively energized in response to entry of the proper combination code. Here, the system is mounted for limiting access to an area secured by door 12 with electrically operated lock 11 mounted therein as a solenoid operated dead bolt assembly for cooperation with a mated door jam receptacle (not shown) in a well-known manner.

Although the access code may be entered into the control system by anyone of a variety of means, the present embodiment employs a plurality of electromechanical push-button switches 13 carried by a code entry panel 14 of a housing 16 mounted on the entry side 17 of door 12. Alternatively, housing 16 and push-button switches 13 may be mounted anywhere including locations remote from the closure which affords access to the secured area.

The control circuitry for the system is preferably mounted inside the secured area, and is here carried within a housing 18 having a control panel 19 and being mounted to the secured side 21 of door 12. In this case, housing 18 is formed as part of a doorknob assembly 22 which includes inside and outside doorknobs 23 and 24, respectively, for operating a striker 26. Additionally, assembly 22 includes a manual actuator 27 for manual operation of dead bolt 28 of lock 11 from within the secured area.

Although a door installation is illustrated here, it will be appreciated that the electronic permutation lock and control system of the present invention may be adapted for installation in any of a variety of situations. For example, the code input means provided by push-button switches 13, electrically operated lock 11 and the control housing and panel 18 and 19 may be arranged for selective access to a bank vault, for selective operation of a computer system or other electrical equipment, for controlled access to or operation of vehicles, etc.

With reference to FIGS. 1 and 3, the series of push-button switches 13 serve as a code input means for the control system with each of the 10 switches here providing a separate one of input lines 31 to the electronic circuitry. Lines 31 may be individually and selectively energized by operating switches 13 to develop the necessary sequence of electrical signals for operating the lock.

It will be noted that the array of push-button switches 13 is only one possible means for entering the sequential electrical signals which form the combination code. As another example, references made to a copending U.S. application Ser. No. 267,640 filed June 29, 1972 and entitled "ELECTRONIC COMBINATION LOCK INCLUDING SEQUENTIAL SIGNAL GENERATOR AND SIGNAL DISPLAY" which discloses another arrangement for developing the code. In that case, the sequence of electrical signals are generated by a single push-button which is selectively opened and closed in coordination with a digital signal generator circuit and a digital display. If desired, such a code input arrangement may be used in place of the array of push-button switches 13 disclosed in the present application. More generally, any means may be utilized which is capable of sequentially energizing a plurality of code input lines in accordance with a predetermined code format.

The input lines 31 are in this case passed through input isolation buffers 32 to a set of error detection gates 33 which as more fully described herein serve to detect any deviation between the actual input signals versus the correct combination code. Isolation buffers 32 merely provide electrical buffering or isolation between the voltage and current levels on input lines 31 and the input levels to error detection gates 33 in a manner well-known to those skilled in the art.

In general, the circuit shown in FIG. 3 responds to entry of the correct code on push-buttons 13 to cause an output circuit means indicated at 36 to drive an electrically operated lock to the open condition permitting access to the secured area. For this purpose, a valid sequence counter means indicated at 37 is provided with a plurality of output states which are energized sequentially in a stepwise fashion each time one of push-buttons 13 is actuated. In particular, counter means 37 includes a multistate electronic counter 38 having a clocking input 39 connected and jointly responsive to the energization of anyone of input lines 31 to advance the state of counter 38. Here, this operation is accomplished through a clocking gate 41 having a plurality of inputs 42 connected individually to lines 31 through buffers 32 and having an output 43 issuing a clocking signal to counter 38 each time one of switches 13 is depressed and released. In this particular embodiment, the clocking of counter 38 occurs in response to the electrical transistion of output 43 corresponding to the release of one of switches 13.

If the correct code is entered, counter 38 is stepped through each of its counting states sequentially energizing each of the associated output lines 44 therefrom. When the counter reaches a preselected terminal state, here selected by a code length selector switch 45, then the output circuit 36 is activated over a connecting line 46, causing the electrical lock to open. In this manner, counter 38 serves to detect a valid sequence of signals on input lines 31 corresponding to a properly entered code on push-buttons 13.

If on the other hand, an incorrect one of push-buttons 13 is operated during a code entry sequency either because of carelessness or by reason of an unauthorized person tampering with the control, this error is detected. More particularly, a plurality of error detection gate means are provided for this purpose. In this instance, gate means 47 are embodied in a plurality of individual gates 33, one for each of input lines 31 and each gate having first and second inputs, indicated as a first set of inputs 48 connected to associated ones of input lines 31 and a second set of inputs 49 which are connected to preselected ones of the counter output lines 44. Inputs 49 serve to disable the individual gates 33 which otherwise will issue an output signal over line 51 in response to the energization of anyone of input lines 31 by code switches 13.

By selective connection of the output lines 44 of counter 38 to certain ones of inputs 49 of gates 33 through code selection switch means 52, gates 33 function to issue an error detection signal over output line 51 anytime the operation of switches 13 deviate from the preselected combination code.

For example, assume that switch means 52 has been set as described more fully herein to provide a combination code of 111. As the first digit of the code is entered on switches 13, the number one input line of lines 31 is energized along with the number one input of inputs 48 of gates 33. However, counter 38 of valid sequence counter means 37 is in its first state corresponding to the energization of the zero one of output lines 44. Because of this, the number one input of inputs 49 of gates 33 is disabled through switch means 52 as illustrated and accordingly no error indicating output occurs on output line 51. When the second digit of the code is entered on switches 13, the number one input of input lines 31 is again energized along with the number one input of inputs 48 to gates 33. Prior to this however, counter 38 has been stepped or clocked to its second state corresponding to the number one output line of output lines 44 by a clocking signal applied to clock input 39 from gate 41. As previously stated, in this instance counter 38 is clocked by the trailing edge of a signal corresponding to actuation of one of switches 13 or in other words the advancement of the counter occurs whenever anyone of the push-buttons is released.

Thus, the second output state of counter 38 applies a signal over the number one output line of output lines 44 through switch means 52 again to the number one input of inputs 49 to disable the number one error detection gate of gates 33. When the second digit of the code is entered on push-buttons 13, the proper one of gates 33 has already been disabled by valid sequence counter means 37, again preventing any error indicating signal from being issued over output line 51.

Upon releasing the push-button associated with the second code digit, counter 38 is clocked once again to its third state which in the present example causes the number one input of inputs 49 to disable the number one gate of gates 33 and inhibit any error signals from issuing in response to the third and last code digit. However, if the incorrect one of switches 13 is depressed during a code entry sequence, it will be observed that one of gate inputs 48 will be energized without concurrent energization of the corresponding one of inputs 49, thus failing to disable the proper one of gates 33 and causing an error signal to issue. For every incorrect actuation of switches 13, another error signal will be generated.

Each of the generated error indicating signals on line 51 are transmitted to an error processing and timing circuit means indicated at 53 where the number of errors are accumulated. In response to a selected number of errors, circuit means 53 among other things functions to disable the operation of valid sequence counter means 37 preventing counter 38 from advancing to the selected terminal state which would otherwise operate output circuit means 36. The duration of disablement of valid sequence counter means 37 is determined by a penalty timing interval which is initiated and timed by circuit means 53. Thus, circuit means 53 provides a number of functions including the counting of errors, the timing of the penalty interval, and as more fully described herein the timing of the lock open or latch time interval.

In this embodiment, the various operations of circuit means 53 are advantageously provided by a common electronic counter designated as the error, penalty time and latch time counter 56. This is a multifunction counter means having a plurality of output states which are connected to multifunction selection switch means including in this instance an error number selector switch 57, a penalty time selector switch 58 and a latch time switch 59. Each of switches 57–59 includes a common slide contact 61, 62 and 63, respectively, and a wiper arm 66, 67 and 68, respectively. In this instance, the various switches are independent of one another with each of the wiper arms 66, 67 and 68 being individually movable to contact anyone of output terminals 69 of counter 56.

Consider now the operation of circuit means 53 in response to receipt of error indicating signals over line 51 from gates 33. According to the construction and operation of this embodiment of the invention, error number selector switch 57 may be set to one of output terminals 69 corresponding to a desired error sensitivity of the security system. In other words, switch 57 determines the number of errors which are to be permitted during entry of a combination code on switches 13 prior to disabling the entire system and invoking the penalty period. For example, the security installation may warrant the setting of error selector switch 57 to permit only one or two or even zero errors prior to invoking the penalty interval. In the illustration of FIG. 3, switch 57 is set to the first error position, corresponding in this instance to the second state of the counter 56, to register even a single error introduced at code input switches 13. Thus in this example, the operator is not permitted to make any errors in entering the correct combination code, as the very first error he makes will be registered by counter 56 and switch 57 to activate the penalty mode and disable further advancement of valid sequence counter means 37.

More particularly, this operation is provided by a clocking gate 71 having one of its inputs 72 connected and responsive to line 51 to apply a clocking signal to a clocking input 73 of counter 56 in response to each detected error. In this particular circuit, gate 71 has another input 74 connected to another source and operates to clock input 73 of the counter in response to signals at either of inputs 72 and 74.

In effect therefor, counter 56 has an error counting mode in which it is clocked by error detection gates 33 and cooperates with selector switch 57 to register the preset number of errors to be permitted. Assuming that the set number of errors has been reached and contact 61 has been energized by the connection of wiper arm 66 to the energized output state of counter 56 then this circuit condition triggers the penalty interval.

For this purpose error processing and timing circuit means 53 further includes in this instance a penalty time activate circuit means in the form of circuit 76 and a clock generator circuit means in the form of circuit 77. These circuit means function in combination with counter 56 to set the control circuitry in the penalty mode and to determine the time interval for this mode.

In this embodiment, circuit 76 may be provided by a flip-flop or bistable switching circuit having a set input 78 which receives the output signal from contact 61 of switch 57 to dispose circuit 76 in a set state, constituting one of two stable states of the circuit. An output 81 of circuit 76 issues a signal which has been designated as (PT). The penalty time or (PT) signal is connected to control various circuit components of the system as illustrated by the (PT) designation at the inputs of several circuit blocks diagramed in FIG. 3.

Upon assuming the set condition, circuit 76 through output 81 turns on clock generator circuit 77 which thereupon issues a relatively low frequency pulse train signal over output 82. This low frequency pulse train which may for example be on the order of one pulse per second is extended to input 74 of gate 71 for clocking input 73 of counter 56. When this occurs, counter 56 assumes a penalty time counting mode and penalty time selector switch 56 cooperates therewith to set a desired penalty time interval. In particular, wiper arm 67 is set to one of output terminals 69 of the counter corresponding to an associated counting state thereof. When counter 56 advances to the output state selected by switch 58 in response to the train of clock signals from circuit 77, then contact 62 through wiper arm 67 registers that occurrence and as described more fully herein terminates the penalty mode over a connecting line 83.

At the same time that clock generator circuit 77 is activated by circuit 76, the (PT) signal at output 81 is extended to an input 84 of a gate circuit 86 for disabling counter 38 of counter means 37. Circuit 86 has an output connected to a clear input 87 of counter 38 for responding to a number of inputs including the (PT) signal at input 84 to selectively disable or enable counter means 37. In this instance, input 84 receiving the penalty time (PT) signal causes circuit 86 to disable counter 38 by clearing and holding it in its zero or nominal output state.

Additionally, the penalty time (PT) signal at output 81 of circuit 76 is fed to a latch time and reset disable gate 88 having an output connected to a reset input 89 of a latch time activate circuit 91. Circuit 91 forms part of the output circuit means 36 and is the principal control element for energizing the electrically operated lock as more fully described herein. The (PT) signal applied to input 92 of gate 88 serves in effect to disable circuit 91 from operating the lock means so long as the system is in the penalty time mode. It will thus be observed that the penalty mode forecloses operation of the electrical lock and disables the entire system from receiving any further code input. As indicated above, the duration of the penalty time may be set by selector switch 58 and in this particular embodiment a range of approximately 1 through 25 seconds is available depending upon the security needs.

Circuit means 53 provides the still further function of determining the time interval for which the electrically operated lock can be disposed in the open or release condition. This duration is sometimes referred to as the latch time. It is important to enable the opening of the door or other security closure for only the time span necessary for an authorized personnel or if appropriate a group of personnel to reach and pass through the security entrance.

The capability of setting this latch time is provided in this instance by switch 59 having wiper arm 68 setable to one of the output states of counter 56 and the cooperative operation of clock generator circuit 77 to supply counter 56 with timing pulses. To appreciate fully this function of circuit means 53, a complete operating sequence will be described in which the correct code is entered and output circuit means 36 is activated to operate the electrical lock.

When the first push-button switch of switches 13 is depressed, the control system of FIG. 3 is disposed in a mode referred to as an operate mode. In this mode, an operate timer means is provided for detecting an initial actuation of one of push-button switches 13 and permitting the system to remain in the operate mode only for a predetermined time following the initial contact at push-buttons 13. At the end of this time interval, the circuit switches out of the operate mode and if one of push-buttons 13 is subsequently actuated, the entire system is reset and the code entry must begin anew. The duration of the operate time mode determined by circuit 102 is not believed critical, however in this instance, approximately 5 seconds are provided from the release of anyone of push-buttons 13 within which the next push-button must be actuated to maintain the circuitry in the operative mode. Accordingly, by this means a limitation is introduced on the duration which may be taken to enter full code sequence. Additionally, the operate timer means serves to restore the circuit to an initial quiescent condition a short time after an incorrect or incomplete code entry.

In this particular embodiment, an output 104 of timer circuit 102 is connected through an operate logic gate 106 to develop an operate mode signal at an output 107 thereof, herein designated as the (OP) signal. The (OP) signal is the principal control signal for the operate mode and is connected to selectively enable the principal circuit means of the system. More particularly, the operate mode (OP) signal is connected to an input 108 of gate circuit 86 to initially clear and thereafter enable counter 38 to respond to clock signals at input 39. Similarly, the operate mode (OP) signal is connected to a reset input 109 of penalty time activate circuit 76 to reset and thereafter enable this circuit in response to the system assuming the operate mode. Reset and disable gate 88 also receives the operate mode (OP) signal at an input 111 for enabling latch time activate circuit 91 at a reset and enable input 89. Finally in this embodiment, the OP signal is connected to an input 112 of counter 56 to initially clear and thereafter enable the counter to carry out its multiple function modes.

Assuming now that the system has been disposed in the operate mode and the correct code sequence has been entered on push-buttons 13 and the selected terminal state of counter 38 has been reached to cause line 46 to be energized through code selector switch 45. Line 46 is connected to a set input 113 of latch time activate circuit 91. Circuit 91 may be provided as in this case by a flip-flop or bistable circuit having a normal, reset state and being responsive to the signal on line 46 to assume a set stable state in which the electrical lock is activated. An output 114 of circuit 91 provides a latch time signal designated (LT) which in the set condition of the circuit provides for activating a latch driver circuit of output means 36 through a buffer circuit 115. As long as circuit 91 remains in its set state, the latch driver circuit to be more fully described herein maintains the electrical lock 11 of FIGS. 1 and 2 in the open condition.

Simultaneously, the latch time (LT) signal is extended from output 114 to and for controlling various other circuit components of the system. One of these components is the clock generator circuit 77 which receives the (LT) signal over a connecting line 116. Clock generator 77 responds to the (LT) signal in the same manner that it responded to the penalty time (PT) signal and assumes an active condition in which the relatively low frequency clock pulses are issued at output 82 and extended therefrom to and for clocking counter 56 through clocking gate 71. The moment the electrical lock 11 is opened, circuit means 53 thus starts counting through the cooperation between circuit 77 and counter 56 to measure the open time or latch time of the system. The length of this time may be selected as previously indicated by latch time selector switch 59. By setting wiper arm 68 at a selected one of output terminals 69 of counter 56, a latch time end signal will be issued over common connector 63 to a connecting line 117 to terminate the latch time.

For this purpose a latch end gate 118 is provided having an enable input 119 connected to receive the latch time (LT) signal from output 114 of circuit 91 and another input 121 for receiving the latch end signal over line 117. In response to these two inputs, an output of gate 118 issues a latch time terminating signal to an input 122 of gate 106 for causing output 107 of this gate to issue an operate (OP) signal for restoring all of the circuit components to their reset or initial conditions. This enables the system to receive a new input code sequence.

Logic gate 106 also has an input 124 connected to an output of a penalty end gate 126 which provides a similar function to gate 118 in that it causes gate 106 to issue an operate (OP) signal for restoring the circuitry at the termination of the penalty time period. More particularly, gate 126 has an enable input 127 which is enabled by the penalty time (PT) signal from circuit 76 and another input 128 which is responsive to the penalty time termination signal on line 83 from penalty time selector switch 58.

A hold gate 131 may be provided having inputs 132 and 133 connected to the latch time (LT) and penalty time (PT) signals for issuing a gating signal to input 134 of timer circuit 102 to hold the timer in the operate mode until the end of either the penalty time or latch time intervals. Thus, gates 118, 126 and 131 cooperate with operate timer circuit 102 and operate logic gate 106 to restore the system to the reset, initial condition following either the latch time in the event of a successful code entry or at the termination of the penalty time in the event of an unsuccessful attempt.

To permit a variable length code depending upon the desired security level, a code length selector switch means is provided in the form of selector switch 45. This switch serves to select a desired terminal state of valid sequence counter 38 for shortening or lengthening the number of digits of the code which must be entered on switch 13 for operating the lock.

More particularly, switch 45 includes a common contact 136 connected to line 46 and a movable wiper arm 137 for selective electrical connection to one of output lines 44 associated with the counting states of counter 38. In this instance, wiper arm 137 may be set on anyone of the second through fifth output states of the counter corresponding to the third through sixth digit of a six digit input code. For low security time periods or low security installations, switch 45 might be adjusted as shown in FIG. 3 to limit the length of code to three digits. In such case, valid sequence counter means 37 need be stepped only through three of its output counting states to activate line 46 and output means 36 for opening the lock. On the other hand, wiper arm 137 may be set to the fifth counting state of counter 38 to require entry of the full six digit combination code on push-button input switches 13.

As previously indicated, the combination code may be set and changed at will through the use of code selector switching means 52. For this purpose a plurality of individually, manually operable digit selector switches 141 are provided, one for each digit of the multiple digit code. In this instance, the system permits a six digit code corresponding to the six available output states of counter 38 and accordingly, six individual switches 141 are provided (three of them are shown in FIG. 3). Each of these switches includes a wiper arm 142 separately connected to an individual one of output lines 44 corresponding to an associated output state of counter 38. These wiper arms 142 are each movable to connect one of a plurality of terminals 143 associated with each of the switches, one terminal for each of the code entry input lines 31 associated with switches 13. Furthermore, all of the corresponding ones of terminals 143 for the entire plurality of switches 141 are common bused as indicated at 144 so that anyone of switches 141 may be connected to anyone of inputs 49 of gates 33. Also, two or more of switches 141 may be set to connect the associated output lines 44 to the same input 49. For example as illustrated in the drawings, each of switches 141 has its wiper arm 142 set to the number one position for connecting all of the associated output states of counter 38 to the number one input of inputs 49 providing an input code of numbers 111111. To permit the connection of the terminals for two or more switches 141 to a common one of inputs 49, isolating buffers 146 are interposed between output lines 44 and associated wiper arms 142 of the selector switches.

With reference again to FIGS. 1 and 2, the entire electronic circuitry of FIG. 3 may be constructed to miniature or integrated electronic parts and mounted within housing 18 of FIG. 2. The plurality of code selector switches 141, code length selector switch 45, error number selector switch 57, penalty time selector switch 58 and latch time selector switch 59 may all be mounted on control panel 19 also as shown in FIG. 2. Thumb operated slide actuators 151 may be used as shown in FIG. 2 for positioning the various wiper arms of these switches. A slidable closure 152 may be incorporated in housing 18 to hide and protect control panel 19.

Although, in general the output circuit means 36 may be connected to actuate or drive any electrically responsive security control, in this instance a particular and preferred electric latch or solenoid driver circuit is disclosed. This solenoid driver circuit 151 as shown in FIG. 4 is connected to receive an electrical actuating signal at an input 152 from the output of latch time activate circuit 91 of output means 36 as shown in FIG. 3. Here, the initiating signal is applied to input 152 through buffer circuit 115 from output 114 of circuit 91.

In response to the electrical control function applied at input 152, the circuit 151 of FIG. 4 provides an advantageous high surge current for initially displacing a solenoid 153 of electrically operated lock 11 and thereafter producing a lower level sustaining current for holding the solenoid in its displaced condition. In general, circuit 151 may be connected to drive any desired electromechanical lock in which a large initial surge current followed by a lower sustaining current is required. With reference to FIG. 1, solenoid 153 may be mounted in cooperation with the dead bolt assembly 154 in a manner well-known in the art to form the complete electrically operated lock 11. In this particular instance, lock 11 is designed to have a normal unenergized state in which dead bolt 28 is in its projecting condition (not shown) locked within the cooperating receptacle of the door jam. Upon energizing solenoid 153, the dead bolt 28 is displaced to its retracted condition thus releasing door 12 from the locked, secured condition. An electrically operated lock 11 mounted and operating in this manner is sometimes referred to as an electric release.

Principally, circuit 151 includes a switchable serial discharge circuit path means indicated at 154 for passing a current I through solenoid 153. More particularly, this would be the serial connection to the coil or winding of solenoid 153.

This circuit path means 154 may be switched between a relatively high impedance normal state and a relatively low impedance discharge state by a transistor switching means 156 which is here shown to be serially connected in the circuit path means 154 between solenoid 153 and a ground 157. Preferably, transistor switching means 156 is provided by transistors 158 and 159 connected in a Darlington pair configuration as shown for receiving a switching voltage or current at a base electrode 161 of transistor 158 to cause the collector-emitter path 160 of transistor 159 to switch between the aforementioned high and low impedance conditions. This particular arrangement for transistor switching means 156 serves to provide a highly efficient "off-on" switch in response to a low level electrical signal. In other words, high amplification is provided between the input base electrode 161 of transistor 158 and the switched collector-emitter path 160 of transistor 159.

To provide the surge of high occurrent for initial displacement of a plunger associated with solenoid 153, circuit 151 further includes a charge storage means indicated at 162 and being connected across the discharge circuit path means 154 to dump a large initial current flow through the solenoid coil the instance transistor switching means 156 is driven to its low impedance discharge state.

Charge storage means 162 in this instance includes a charge storage capacitor 163 connected to be charged through a voltage regulator circuit 164. Circuit 164 includes transistor 166, a biasing resistor 167, a Zener diode 168 and a current limiting resistor 169 connected so as to allow a regulated current flow from a voltage supply terminal 171 through the collector-emitter path of transistor 166 and through current limiting resistor 169 to and for charging capacitor 163 to a desired voltage or charge level. The size of capacitor 163 is selected to supply the initial surge current for driving the solenoid 153. A locking diode 172 locks in a direct charging of capacitor 163 and forces the charge current through the voltage regulator circuit 164, and yet permits the discharge current I to flow directly to line 173 of the discharge circuit path means 154 thus bypassing the voltage regulator circuit during the discharge mode.

After the initial surge current, a sustaining current is supplied to solenoid 153 maintaining it in its displaced, release condition by virtue of the supply voltage +V applied to terminal 171 as illustrated.

Preferably, transistor switching means 156 is driven in two consecutive modes or stages of operation. A first stage operation is provided by a switching transistor 174 and a capacitor 176 connected between a collector 177 of transistor 174 and a base resistor 178 of transistor 158 for applying a saturation drive current to the base electrode of transistor 158 in response to switching of transistor 174. Transistor 174 is in turn driven by an initial or first in line switching transistor 179 having its base electrode connected to input line 152.

The second stage of drive for transistor switching means 156 is developed by a voltage regulator network including a resistor 181 and a variable resistor 182 connecting the collector electrode 177 of transistor 174 to ground and providing a voltage divider junction 183 therebetween for supplying a second stage regulated and sustaining drive signal to base electrode 161 of the Darlington pair of transistors 158 and 159. After the first stage saturation drive by capacitor 176 the regulated voltage available at junction 183 takes over and sustains the transistor switching means 156 in a suitable low impedance condition for allowing a sustaining current to flow through the solenoid coil. The sustaining current through circuit path means 154 may be adjusted by variable resistor 182.

A capacitor 184 connected between the base and emitter electrodes of switching transistor 179 serves to suppress transients, while resistors 186, 187 and 188 are for biasing the operating conditions of transistors 174 and 179.

In this particular embodiment, the end of the latch or lock open time is determined by the duration of the latch activate signal applied to input line 152 from the output 114 of circuit 91. When circuit 91 reassumes the reset condition, the signal on input line 152 is terminated and transistor switching means 156 is switched back to its relatively high impedance normal condition.

This terminates the flow of current through solenoid 153.

With reference to FIGS. 5 and 6 an alternative embodiment of the present invention is illustrated in which a control box 201 having a control panel 202 similar to control panel 19 of FIG. 2, is provided for mounting inside a secured area for controlling an electrically operated lock 203 in response to a code input means 204. In this instance, the system is provided with a time lock function in addition to the other control features of the embodiment shown in FIGS. 1 through 4. The time lock may be utilized in a variety of applications including bank vaults, office buildings, military installations, and in general in any situation where it is desired to permit access to the secured area only after a preprogrammed time.

Electrically operated lock 203 may thus, for example, be installed to control the opening of a bank vault, while code input means 204 may include the plurality of input push-buttons 13 of the previously described embodiment. The time lock function enables the response of the control system to entry of the proper code only after expiration of the preset time.

Although time locks are in general known, the particular construction and operation of the present timing system is especially advantageous and compatible with electronic combination locks such as the system shown in FIG. 3. With reference to FIG. 6, a time lock circuit 206 is shown for cooperating with the control system of FIG. 3 by the provision of a transistor switch circuit 207 which may be connected to selectively enable or disable output circuit means 36 of FIG. 3. In other words, the timing circuit 206 may be combined with the circuit of FIG. 3 and mounted therewith inside of control box 201. For this purpose, transistor switch circuit 207 is provided with a terminal 208 for connection to output circuit means 36, such as at the junction of the output of buffer circuit 115 and the input 152 to the latch driver circuit for selectively inhibiting the operation of latch driver circuit 151 under predetermined conditions. As one example, circuit 207 and output terminal 208 might merely provide for grounding of the output signal available from buffer circuit 115 such that input 152 never receives any activating signal from output means 36 so long as this circuit condition continues.

To provide the timing function for controlling the condition of transistor switch circuit 207, a digital clock circuit means 209 is provided along with a light emitting diode (LED) digital display for indicating the time information available within clock 209.

I have found that suitable timing functions are available by using a commercial, off-the-shelf digital alarm clock module for clock 209, wherein such module includes all the necessary logic for constructing a setable alarm clock and is constructed with suitable outputs for direct interfacing with standard, commercially available digit displays such as seven-segment florescent tubes, liquid crystal displays or as in this case light emitting diode display 211. Although a number of commercially available integrated circuit modules are available, the presently described embodiment utilizes a module manufactured and sold by National Semiconductor Corporation as their integrated circuit MM5316 digital alarm clock.

Most of the commercially available devices including the herein disclosed integrated clock 209 may be driven by a suitable clock frequency which in this instance is developed by a precision crystal oscillator 212 divided in frequency by a frequency divider circuit 213 to produce a 60 Hz clock frequency at a clock input 214 of clock 209 after passing through a buffer 216. Oscillator 212 is preferably of a higher frequency than the 60 Hz input such that frequency divider circuit 213 may divide a higher, stable frequency down to the lower frequency level for accurate timing of clock 209. In the alternative, clock input 214 may receive a suitably pulse-shaped 60 Hz line voltage, thus eliminating the necessity of oscillator 212 and divider circuit 213.

Clock 209 in response to the 60 cycle clocking signal input provides a timing cycle based on a 24 hour interval. That is, clock 209 paces through the hours and minutes for a 20 hour cycle or period, and then begins another 24 hour period.

Integrated clock 209 and modules like this are intended to be used as the heart or central control of an alarm clock. For this purpose, clock 209 includes an alarm signal output 216 and alarm set and alarm reset inputs 217 and 218 for setting the clock to cause the issuance of a periodic timing signal which is normally used as an activating signal for an alarm clock device such as a buzzer or the like. In this instance, the periodic timing signal available at alarm output 216 at a preselected time during each 24 hour full cycle or period is used in a manner different from the intended function.

In particular, a day counter means is provided, here in the form of electronic counter 219, for receiving each alarm output signal from output 216 as it is issued during each 24 hour cycle to accumulate the number of 24 hour periods or days which have elapsed since the setting of the clock 209.

In other words, clock 209 may be set to issue the alarm trigger signal at a particular time of the day and for each full 24 hour cycle this alarm trigger signal will be reissued at output 116. In the normal application of clock 209, the alarm function of the clock would be reset or turned off after each alarm actuation, however in the present embodiment the repeatability of the alarm trigger signal is advantageously used to develop a controlled timing function which is based not only on the hours and minutes but also the number of days which have elapsed since the initial setting of the time lock.

For this purpose, counter 219 includes a clocking input 221 connected to alarm output 216 through a buffer 222. Additionally, counter 219 is provided with a plurality of output states and associated output terminals 223 for registering the accumulated number of alarm output trigger signals from output 216 which as indicated above correspond to the number of elapsed days since the setting of clock 209. Moreover, it will be observed that the counter 219 will be clocked to a succeeding counting state precisely at the time in hours and minutes that clock 209 has been previously set. Accordingly, the timing information available on output terminals 223 of counter 19 includes not only the number of elapsed days but also the particular time during any given day at which the alarm function of the clock 209 has been set.

This setting of the elapsed number of days and the time in hours and minutes during any given day is utilized to provide a time lock for the control system of FIG. 3. For this purpose, counter 219 is provided with a day selector switch 224 having a common electrical contact 226 connected to transistor switch circuit 207 through a buffer 227 and a transistor driver 228, and having a wiper arm 229 which may be set on one of counter outputs 223. The setting of wiper arm 229 will be determined by the desired number of days which must expire before the combination lock is capable of responding to the proper code input. In this particular embodiment, the first position of switch 224 is an off position which disposes transistor switch circuit 207 in an unactuated condition so that the output means 36 of FIG. 3 is enabled to drive the latch drive circuit 51 in a normal manner. The second or test position of switch 224 drives circuit 207 to its disabling or inhibiting condition to test the operation thereof.

The first timing position of switch 224 enables the day counter means to be set to a zero number of elapsed days for timing intervals shorter than the full 24 hour cycle of clock 209. The second, third and successive positions of wiper arm 229 provides settings of one day, two days, etc., on up to a desired number of maximum days which in this instance is nine days. Day selector switch 224 may be mounted for manual control on panel 202 as shown by manual slide switch actuator 231 along with manual actuators 232 for the code length switch 45, actuator 233 for the error number selector switch 57, actuator 234 for the penalty time selector switch 58, actuator 235 for the latch time selector switch 59 and a set of six manual actuators 236 for the code digit selector switches 141.

To set clock 209 and display the clock time contents thereof, a plurality of push-button switches are provided and these may be mounted on panel 202 as shown in FIG. 5 along with display windows 237 and 238 for digital display 211. A first of these pushbutton switches 241 is arranged to connect a voltage signal here shown as +Vs to the alarm set input 217 for setting the internal alarm circuitry of clock 209 to whatever clock time is displayed at that instance on digital display 211. When switch 241 is actuated, the displayed time on display 211 need not correspond to the real or actual daytime which is controlled by different internal function of the clock. To change the alarm set time, either a slow or fast push-button switch 242 or 243 is actuated to cause the display time to advance at a fast and then slow rate to approach the desired time setting. When the hours and minutes displayed in windows 237 and 238 reach the desired time to which the clock is to be set, then switches 242 and 243 are released and switch 241 may be actuated to confirm the correct setting.

Still another manually operated push-button switch 244 is provided in this case for displaying the real time of day which is always computed or available within clock 209. In this instance in order to conserve electrical power and component life, display 211 is normally in an unenergized condition and must be energized by either push-button switch 241 or 244 in order to energize the light emitting diodes thereof. The display is energized by alarm set switch 241 over a connecting line 246 which is connected as one of the inputs of an or gate 247 for activating a display input 248 which may merely be the supply voltage input for the display. Alternatively, the real time display may be energized by switch 244 which is connected through another input of gate 241 for also energizing input 248. In this instance, input 248 of clock 209 is intended for direct permanent connection to a supply voltage so as to cause the display associated with the alarm clock to be permanently energized for always displaying the real time. Thus, the output of gate 247 from switches 241 and 244 merely serve to selectively connect a supply voltage for energizing the digital display.

For convenience, the day counter 219 is reset over a connecting line 249 each time either alarm set switch 241 or the real time display switch 244 is actuated. Such actuation of either one of these switches returns the system to an initial timing state in which the number of days set by switch 224 must elapse before the electronic lock can be opened. Line 149 for this purpose is connected to a reset input 151 of counter 219.

Each time an alarm trigger signal is issued at output 216 for advancing the state of counter 219, the alarm is reset over a line 252 which connects the output 216 through buffer 222 to an alarm reset input 218 of clock 209. Thus during each 24 hour cycle, the periodic alarm signal is issued and the clock is reset for the next 24 hour cycle.

When counter 219 has accumulated the selected number of days set by switch 224, then an output signal is issued over contact 226 for driving transistor switch circuit 207. Simultaneously therewith, a clock disable input 253 of counter 219 is energized over a line 253 connected to contact 226 through buffer 227 for disabling the advancement of the counter and holding the output thereof in the selected output state. In such condition, transistor switch circuit 207 will be indefinitely disabled once counter 219 has registered the selected number of elapsed days such that the combination lock may be opened at anytime subsequent to the preset lock open time.

The operation of push-button switches 241, 242, 243 and 244 may be effected by manual pressing of associated push-button actuators 261, 262, 263 and 264 mounted as illustrated on panel 202 in FIG. 5.

In most installations, the circuitry of control box 201 of FIG. 5 may receive the electrical operating power over a line 266 from the standard line voltage available in the building or other installation. In the event of power losses, an emergency battery 267 may be provided for temporarily supplying the electrical circuits over a cable 268. Preferably, battery 267 is of a chargeable type, and the circuitry within control box 201 may include an automatic charging circuit in which line voltage available from line 266 is utilized to develop a charging current for battery 267. Alternatively, a portable battery may be available for plug-in connection to control box 201 during an emergency power loss.

An emitter resistor 189 may be connected in the serial discharge path in association with transistor 159 as shown to regulate the sustaining current in conjunction with variable resistor 182. Additionally, a diode 191 connected in parallel with solenoid 153 and reverse biased may be provided to suppress undesirable transients otherwise occurring during the driving of solenoid 153.

While only a limited number of embodiments of the present invention have been disclosed herein, it will be readily apparent to persons skilled in the art that numerous changes and modifications may be made thereto without departing from the spirit of the invention. Accordingly, the foregoing disclosure and description thereof are for illustrative purposes only and do not in any way limit the invention which is defined only by the following claims.

I claim:

1. In a security control system having an electrically operated lock means and code input means for selectively and sequentially energizing a plurality of input lines in accordance with a predetermined combination code, the combination therewith comprising:

valid sequence counter means having a plurality of output states and an input connected and responsive to the plurality of input lines for causing said counter means to successively assume each of its counting states in response thereto;

error detection means connected between said input lines and the output states of said valid sequence counter means for detecting the erroneous energization of one of said input lines not in conformance with the predetermined code and for disabling the control system in response thereto;

error processing circuit means coupled to the output of said error detection means including means for accumulating a preselected number of error indicating signals from said error detection means, said error processing circuit means being coupled to said valid sequence counter means for disabling said valid sequence counter means in response to said accumulation of said preselected number of error indicating signals; and output means for selectively connecting one of the output states of said valid sequence counter means to and for operating said electrically operated lock means, whereby said valid sequence counter means must be successfully advanced to the above-mentioned selected output state without prior disablement of the control system in order to successfully operate the electrically operated lock means.

2. In the security control system of claim 1, the combination further comprising, a manually operated code length selector switch means connected between the output states of said valid sequence counter means and said electrically operated lock means to enable the operation of the lock means after energization of a preselected number of said input lines by said code input means.

3. In the security control system of claim 1, the combination further comprising code combination selector switching means connected between the plurality of output states of said valid sequence counter means and said error detection means in order to permit changing of the predetermined combination code which will successfully advance the valid sequence counter means to be selected output state before displacement of the control system by said error detection means.

4. In the security control system of claim 1, said error processing circuit means further including means for selecting the number of error indicating signals which must be produced by said error detection means prior to disabling said valid sequence counter means.

5. In the security control system of claim 1, said error processing circuit means further including means for maintaining the disablement of said valid sequence counter means for a penalty time interval measured by said error processing circuit means.

6. In the control system of claim 5, said error processing circuit means further including means for selecting the duration of said penalty time.

7. In the security control system of claim 1, the combination further comprising:

inhibit circuit means connected to said output means and being initially disposed in an inhibit condition in which the operation of said output means is inhibited and the electrically operated lock means cannot be operated thereby and said inhibit circuit means capable of being disposed in an enable condition to which said output means will operate said electrically operated lock means in response to the selected output state of said valid sequence counter means;

a digital clock circuit means having a timing cycle based on a 24 hour period;

said clock circuit means including an output means for issuing a periodic timing signal and including setting means for setting said circuit means to issue such timing signal at a preselected time during each said 24 hour period;

display means for displaying the instantaneous time associated with said clock circuit means and for displaying said preselected time to which said clock circuit means is set to issue said timing signal;

day counter means having a clocking input connected to receive said periodic timing signals and having a plurality of output states for registering the accumulated number of timing signals received by said day counter means corresponding to the number of days elapsed;

day selector switch means connected to said day counter means for selectively responding to one of said output states of said day counter means;

said inhibit circuit means being connected to said day selector means and being responsive to said day counter means assuming the output state selected by said day selector switch means to assume said enable condition, whereby said electrically operated lock means may be successfully operated by said code input means only after the expiration of the preselected time and day to which said clock circuit means and said day counter means have been set.

8. In the security control system of claim 7, said clock circuit means being provided by a solid state, integrated, alarm clock circuit and said periodic timing signal being provided by the alarm trigger signal output of said circuit.

9. In the security control system of claim 1, said output means including an electric solenoid driver circuit for energizing a solenoid associated with said electrically operated lock means, said solenoid driver circuit comprising:

switched serial discharge circuit path means adapted to be serially connected to said solenoid and including a transistor switching means for switching said circuit path means between a relatively high impedance normal state and a relatively low impedance discharge state;

a capacitive charge storage means for accumulating an electrical charge and for being connected across said discharge circuit path means for dumping said electrical charge through said solenoid in response to said transistor switching means being switched to its low impedance discharge state.

10. In the control system of claim 9, said transistor switching means comprising a pair of transistors connected as a Darlington pair, and further including a transistor circuit connected to and for driving said Darlington pair of transistors in response to said output means and having a first electrical drive stage in which said Darlington pair of transistors is driven to said relatively low impedance discharge state by capacitive saturation of the base of a first of said Darlington pair of transistors and a second stage of electrical drive in which a regulated voltage is applied to the base of said first transistor of said Darlington pair to sustain said pair of transistors in said relatively low impedance discharge state following the first stage saturation drive.

11. In the control system of claim 9, said capacitive charge storage means comprising a capacitor for accumulating said electrical charge, a voltage regulator means for charging said capacitor from a voltage supply, and a discharge diode connecting said capacitor to said discharge circuit path means for causing said capacitor to be charged through said voltage regulator means and yet permitting direct discharge of said capacitor through said discharge circuit path means in which said voltage regulator means is electrically bypassed.

12. In the security control system of claim 1 in which said code input means is provided by manually actuated push-button means and wherein the predetermined combination code is developed by sequential actuation of said push-button means, the combination further comprising:

an operate circuit means including an operate timer circuit connected to respond to energization of any one of said plurality of input lines associated with said code input means and said manual actuator means;

said operate circuit means having a disable mode and an enable mode, said operate circuit means being connected to said valid sequence counter means for disabling operation of said counter means in said disable mode and being connected to said plurality of input lines for responding to energization of any one thereof to assume said enable mode in which said valid sequence counter means is enabled; and said timer circuit of said operate circuit means functioning to maintain said operate circuit means in its enable mode for a predeteremined interval following energization of any one of said input lines, whereby the correct combination code sequence must be entered by successive actuation of said push-button means so that the proper input lines are each energized within the time interval determined by said timer circuit of said operate circuit means.

13. In a security control system having an electrically operated lock and code input means mounted for access outside a secured area and a control circuit mounted for access only inside the secured area, the combination comprising:

said code input means including a plurality of input lines connected to said control circuit in which the individual lines may be selectively energized in accordance with a predetermined code;

said control circuit including a valid sequence counter means having a clocking input connected jointly to a plurality of said input lines and having a preselected number of output states and associated output lines;

said control circuit further including a plurality of error detection gate means each having an input connected to said input line and another input adapted to be connected to a preselected one of said counter means output lines to cause said gate means to issue an error indicating signal in response to energization of an input thereof by the associated input line unless disabled by the appropriate output state of said counter means having the associated output line thereof connected to the other input of said gate means;

said control circuit further including error processing and timing circuit means connected to said gate means and responsive to a preselected number of error indicating signals to disable said valid sequence counter means; and output circuit means for operating said lock means, said output circuit means being connected to a preselected one of said output states of said counter means designated as a terminal state so as to activate said output circuit means only upon said counter means being clocked to said preselected terminal state, whereby said electrically operated lock means is opened only after successfully clocking said counter means by said code input means through said plurality of states to reach said preselected terminal state without causing said error counting circuit means to disable said sequence counter means.

14. In the control system of claim 13, said control circuit further comprising a code length selector switch means mounted so as to be accessible only inside the secured area and providing for selectively connecting any individual one of said output lines of said valid sequence counter means to said output circuit means, thereby enabling a preselected one of said output states of said counter means to function as said terminal state.

15. In the security control system of claim 13, said error processing circuit means comprising:

a multi-function counter means including a plurality of output states, an error number selection switch means, a penalty time selection switch means, a penalty time activate circuit means and a clock generator circuit means;

said multi-function counter means having a clocking input connected to and for being clocked by said error detection gate means and by said clock signal generator means and having a plurality of counting modes including an error counting mode and a penalty time counting mode;

said multi-function counter means in its error counting mode being connected to and cooperating with said error number selection switch means to register the number of error indicating signals set by said error number selection switch means and to cause said disabling of said valid sequence counter means in response thereto;

said penalty time activate circuit means being connected to said multi-function counter means and to said error number selection switch means and to said clock signal generator means to activate said clock signal generator means in response to said multi-function counter means registering the set number of error indicating signals;

said multi-function counter means in its penalty time counting mode being connected to and cooperating with said penalty time selection switch means to register a preselected number of clock signals issued by said clock signal generator means, said number of clock signals corresponding to a desired penalty time period; and penalty time termination circuit means connected to said multi-function counter means and to said penalty time switch means for enabling said valid sequence counter means in response to said multi-function counter means registering said preselected number of clock signals, whereby said valid sequence counter means is restored upon expiration of said penalty time to a condition for accepting another code entry attempt.

16. In the security control system of claim 15, said output circuit means including a latch activate circuit means having a normal unactivated state and being responsive to said preselected terminal state of said valid sequence counter means to assume an active state in which said electrically operated lock means is operated;

said error processing circuit means further comprising a latch time selector switch means connected to and for providing said multi-function counter means with a latch time counting mode;

said latch activate circuit means being connected to and for activating said clock signal generator means along with operating said lock means;

said multi-function counter means in its latched time counting mode being connected to and for cooperating with said latch time selector switch means to register a selected number of clock generator signals set by said latch time selector switch and corresponding to a desired latch time; and said latch activate circuit means being responsive to said multi-function counter means registering said set number of clock generator signals to resume its normal inactive state, whereby the time during which said electrically operated lock is unlatched is set by said latch time selector switch.

17. In the security control system of claim 16, said error number selection switch means, penalty time selection switch means and latch time selection switch means including manual actuators mounted for manual operation inside said secured area for setting said control circuit to a desired security level.

18. In the security control system of claim 15, said multi-function counter means comprising a single electronic counter having a clocking input and plurality of output states, and said error number and penalty time selection switches having common connections to said plurality of output states of said single electronic counter, whereby only one counter is required to perform the two different functions of error counting and penalty time counting.

19. In the security control system of claim 16, said multi-function counter means comprising a single electronic counter having a plurality of output states and each of said error selection switch means, penalty time switch means and latch time switch means having common connections to said plurality of output states, whereby the single counter performs the three different functions of error counting, penalty time counting and latch time counting.

20. In a security control system having an electrically operated lock means and code input means for selectively and sequentially energizing a plurality of input lines in accordance with a predetermined combination code, the combination therewith comprising:

valid sequence counter means having a plurality of output states and an input connected and responsive to the plurality of input lines for causing said counter means to successively assume each of its counting states in response thereto;

error detection means connected between said input lines and the output states of said valid sequence counter means for detecting the erroneous energization of one of said input lines not in conformance with the predetermined code and for disabling the control system in response thereto;

error processing circuit means connected to said error detection means for receiving error indicating signals therefrom;

said error processing circuit means having a multi-function counter means with a plurality of output states, an error number selection switch means, a penalty time selection switch means, a penalty time activate circuit means and a clock generator circuit means;

said multi-function counter means having a clocking input connected to and for being clocked by said error detection means in response to said error indicating signals and by clock signals from said clock signal generator means and said multi-function counter means further having a plurality of counting modes including an error counting mode and a penalty time counting mode;

said multi-function counter means in its error counting mode being connected to and cooperating with said error number selection switch means to register the number of error indicating signals set by said error number selection switch means and to cause disabling of said valid sequence counter means in response thereto;

said penalty time activate circuit means being connected to said multi-function counter means and to said error number selection switch means and to said clock signal generator means to activate said clock signal generator means in response to said multi-function counter means registering the set number of error indicating signals;

said multi-function counter means in its penalty time counting mode being connected to and cooperating with said penalty time selection switch means to register a predetermined number of clock signals issued by said clock signal generator means, said number of clock signals corresponding to a desired penalty time period;

penalty time terminating circuit means connected to said multi-function counter means and to said penalty time switch means for enabling said valid sequence counter means in response to said multi-function counter means registering said preselected number of clock signals, whereby said valid sequence counter means is enabled upon expiration of the penalty time and said control system is restored to a condition for accepting another code entry attempt; and output means for selectively connecting one of the output states of said valid sequence counter means to and for operating said electrically operated lock means, whereby said valid sequence counter means must be successfully advanced to the above-mentioned selected output state without prior disablement of the control system in order to successfully operate the electrically operated lock means.

21. In a security control system in which an electric solenoid serves as a selectively operated electrical lock, a solenoid driver circuit for energizing said solenoid comprising:

switched serial discharge circuit path means adapted to be serially connected to said solenoid and including a transistor switching means for switching said circuit path means between a relatively high impedance normal state and a relatively low impedance discharge state, said transistor switching means comprising, a pair of transistors connected as a Darlington pair, and further including a transistor circuit connected to and for driving said Darlington pair of transistors in response to an electrical actuating signal, said transistor circuit having a first electrical drive stage in which said Darlington pair of transistors is driven to said relatively low impedance discharge state by capacitive saturation of the base of a first of said Darlington pair of transistors and a second stage of electrical drive in which a regulated voltage is applied to said base of said first transistor of said Darlington pair to sustain said pair of transistors in said relatively low impedance discharge state following the initial saturation drive; and a capacitive charge storage means for accumulating an electrical charge and for being connected across said discharge circuit path means for dumping said electrical charge through said solenoid in response to said transistor switching means being switched to its low impedance discharge state.

22. In the control system of claim 21, said capacitive charge storage means comprising a capacitor for accumulating said electrical charge, a voltage regulator means for charging said capacitor from a voltage supply, and a discharge diode connecting said capacitor to said discharge circuit path means for causing said capacitor to be charged through said voltage regulator means and permitting direct discharge of said capacitor through said diode to said discharge circuit path means in which said voltage regulator means is electrically bypassed.

* * * * *